United States Patent [19]

Sedlmair

[11] 4,379,570

[45] Apr. 12, 1983

[54] SKI STOPPER

[75] Inventor: Gerhard Sedlmair, Farchant, Fed. Rep. of Germany

[73] Assignee: Marker-Patentverwertungsgesellschaft mbH., Baar, Switzerland

[21] Appl. No.: 152,193

[22] Filed: May 22, 1980

[30] Foreign Application Priority Data

May 23, 1979 [DE] Fed. Rep. of Germany ..... 2920981

[51] Int. Cl.[3] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 4,101,145 | 7/1978 | Korger | 280/605 |
| 4,173,354 | 11/1979 | Murata | 280/605 |
| 4,194,759 | 3/1980 | Svoboda | 280/605 |
| 4,230,337 | 10/1980 | Storandt | 280/605 |

*Primary Examiner*—Joseph F. Peters, Jr.
*Assistant Examiner*—Milton L. Smith
*Attorney, Agent, or Firm*—Squire, Sanders & Dempsey

[57] ABSTRACT

In a ski stopper having a pivoted spur spring-biassed to swing to a braking position in the absence of a ski boot on a pedal connected to a spur extension, a coupling member displaceable on the spur extension by the biassing spring and the pedal is secured to the ski, or a part fixed thereto, by a connection which is only deliberately releasable.

6 Claims, 4 Drawing Figures

SKI STOPPER

The invention relates to a ski stopper for impeding the movement of a ski down a slope when the ski is detached from the skier's boot. A ski stopper according to this invention preferably comprises a two-armed lever of which the pivot pin extends over the upper ski surface transversely to the ski length and one arm is bifurcated to define two braking spurs at opposite sides of the ski while the other arm operable by the ski boot is spring-influenced, wherein, particularly according to U.S. Patent Application Ser. No. 961,458, filed Nov. 16, 1978, now U.S. Pat. No. 4,294,458 issued Oct. 13, 1981 (German Patent Application P No. 27 51 602.5), one end of a coupling member is mounted to be fixed with respect to the ski at a spacing from the pivot pin, the other end is connected to the lever arm operable by the ski boot by way of a yoke which is parallel to the pivot pin and displaceable lengthwise along the arm operable by ski boot, and the yoke is influenced by at least one spring biassing it away from the pivot pin.

This known ski stopper is, as are many other ski stoppers, to be secured onto the ski either directly or indirectly such as together with a binding portion of a safety ski binding. Direct attachment is by means of a screw connection whereas indirect attachment is by pushing it onto guide rails which are provided or formed on the base plate of a binding portion. Additional securing means that are provided prevent unintentional release of the ski stopper from the guide and thus from the ski.

This last-mentioned embodiment offers the advantage of rapid dismantling and re-assembly of the ski stopper for the purpose of treating the running face of the ski and/or the edges. However, this advantage is achieved by using a disproportionate amount of material which involves higher production costs.

To permit the running face and edges of the ski to be treated without completely dismantling a ski stopper that is directly screw-connected to the ski, retaining brackets have been marketed which are adapted to the particular ski stopper construction and which, when no ski boot is located in the binding, are adapted to hold the stopper in its inoperative position on the ski.

It is the object of the present invention to construct and form a ski stopper of the aforementioned kind so that, for the purpose of treating the running face and edges of the ski, it need be neither removed from the ski nor held in its inoperative position by special auxiliary fittings.

The present invention provides a ski brake having braking spurs biassed by spring means into braking positions. A pedal operable by a ski boot moves the spurs against the spring bias. The ski brake is so constructed as to have a coupling member that is only deliberately releasable from a base plate mounted on a ski. Such a deliberately releasable construction permits the braking spurs to be relieved from the stress of the spring in a simple manner so that they can be easily and under their own weight swung to and practically remain in a position in which they no longer project from the running face of the ski which faces upwardly for the purpose of treatment, i.e. the aforementioned inoperative position.

In a constructional development of the invention, the deliberately releasable connection may comprise a shackle and a hook. The shackle is preferably provided at the end of the coupling member and the hook is bent out of the base plate. Further, an elastic abutment may be provided for the coupling member on the side remote from the arm operable by the ski boot.

One example of the ski stopper according to the invention will now be described with reference to the accompanying drawings, wherein.

Figure 1:
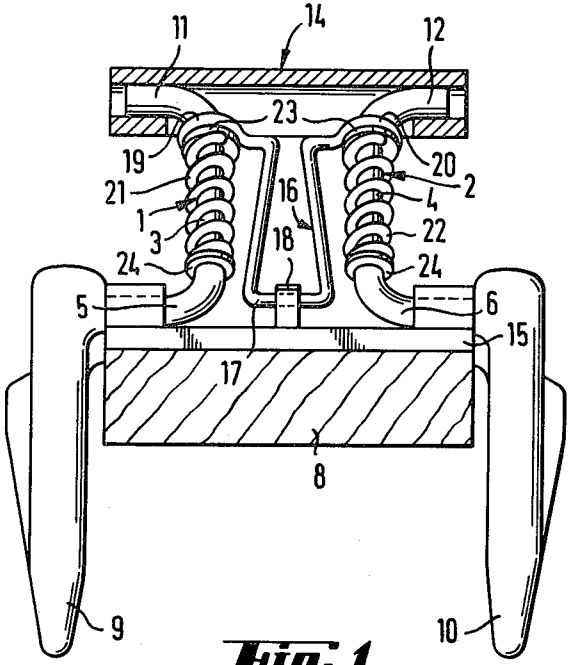
FIG. 1 is an elevation of the ski stopper in its braking position as viewed from the end of the ski.

Turning to the drawings, FIG. 1 illustrates a ski stopper according to the preferred embodiment of this invention as comprising two U-shaped wire frames 1, 2 which are disposed in mirror image symmetry with respect to the longitudinal axis of the ski, their webs 3, 4 defining the first arm of the lever operable by a ski boot and their limbs 5, 6 adjacent the ski defining the pivot pin 7. The limbs 5, 6 project beyond the respective side face of the ski 8 and are there each fixed to a respective braking spur or prong 9, 10. The braking spurs form the second arm of the lever. The limbs 11, 12 of the wire frames 1, 2 serve as a hinge pin 13 for a pedal 14.

The pivot pin 7 formed by the limbs 5, 6 of the wire frames 1, 2 is held on the upper surface of the ski 8 by means of a bearing member 15, preferably in the heel region of the ski boot. The bearing member is screwed to the ski in a manner which is conventional and therefore not illustrated in detail.

Between the two webs 3, 4 of the wire frames 1, 2, there is a coupling member 16 which is likewise of wire bent to U shape and of which the web 17 serves as a shackle which normally engages behind a hook 18 which is bent out of the bearing member 15. The free ends of the limb of the coupling member 16 are flanged outwardly (see FIG. 1) and each bent to form an eye 19 or 20 which embraces the respective web 3 or 4 of the wire frame 1 or 2. These eyes of the coupling member define a yoke which is displaceable along the webs 3, 4 against the force of a helical compression spring 21, 22 which is guided on the respective web and, with the interpositioning of a respective washer 23, acts on the eye 19, 20. At the end of the webs 3, 4 adjacent the ski, the springs 21, 22 are supported by the webs by way of a respective washer 24. The bearing eyes of the pedal 14 serve as abutments for the eyes 19, 20.

Figure 2:
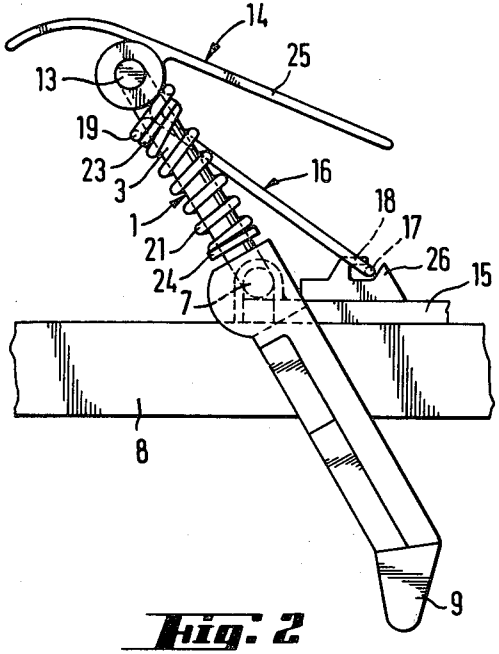
FIG. 2 is a side elevation of the FIG. 1 ski stopper.
Figure 4:
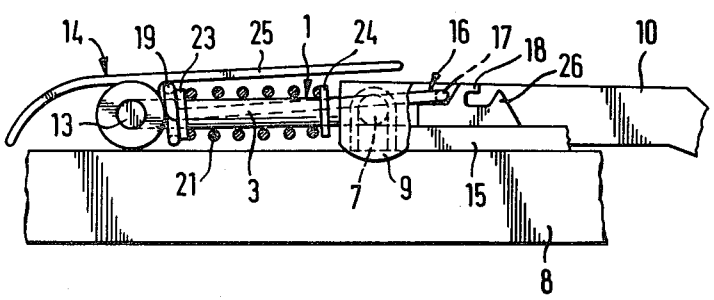
FIG. 4 is a view of the ski stopper similar to FIG. 3 but with the coupling member unhooked.
Figure 3:
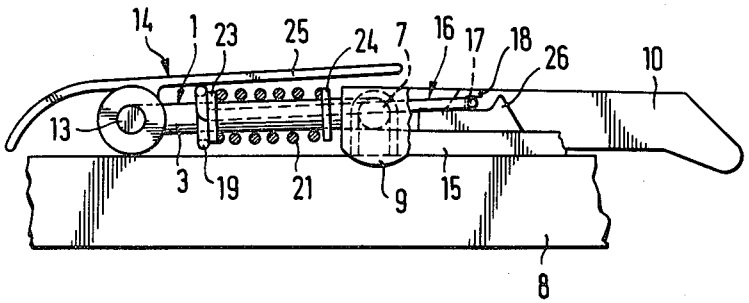
FIG. 3 is a side elevation similar to FIG. 2 but with the ski stopper in its inoperative position, the front braking spur being fragmented for clarity.

As shown in FIGS. 2 to 4, a tab 25 of the pedal 14 forms a cover for the spring and coupling mechanism to protect same.

As in the case of the ski stopper according to earlier referenced U.S. Pat. No. 4,294,458, the ski boot operates the pedal 14 when stepping into the binding and thereby swivels the ski stopper out of its braking position of FIG. 2 into the inoperative position of FIG. 3. The coupling member 16 thereby stresses the springs 21, 22 by way of the eyes 19, 20 so that, when the ski boot is intentionally or unintentionally removed from the ski, the ski stopper automatically assumes its braking position as the springs relax.

When it is necessary to treat the running face or the edges of the ski 8, this construction does not make it necessary to remove the ski stopper from the ski or to use special auxiliary aids to hold it in its inoperative position when the springs are stressed. Instead, the web 17 of the coupling member 16 can be withdrawn from the hook 18, for example with the aid of a screwdriver. This requires a certain resistance of the springs to be overcome which makes unintentional unhooking impossible. After unhooking of the coupling member, the ski stopper can be swung about its pin 7 without effort to reach the FIG. 4 position which corresponds to the inoperative FIG. 3 position except that the helical compression springs 21, 22 are not stressed.

By simply swinging the ski stopper upwardly, the web 17 of the coupling member 16 will be automatically hooked up again after the web has ridden over the free end of the hook 18. The final portion of the pivotal motion of the ski stopper to the hooked-up position of the coupling member takes place against a small amount of resistance produced by the elastic flexure of the coupling member.

A correspondingly effective load on the coupling member is also produced if the braking spurs 9, 10 are loaded from the right-hand side as viewed in FIG. 2. In that case the coupling member 16 will be supported against an abutment 26 of the bearing member 15. The abutment is preferably of elastic material.

For the purpose of providing a clearer illustration of hooking and unhooking of the coupling member 16, the braking spur 9 has been broken away in FIGS. 3 and 4.

The construction according to the preferred embodiment of this invention also permits the ski stopper to be screwed directly to the ski together with and with the same screws as for the base plate, which is preferably the base plate of a heel binding.

I claim:

1. A ski stopper comprising:

a pair of generally U-shaped wire frames having upper and lower limbs facing outward from central limbs;

a bearing member connectable to an upper surface of a ski, said bearing member holding lower limbs of said wire frames for movement about a pivot axis extending transverse to a longitudinal axis of the ski, ends of the lower limbs extending beyond side edges of the ski;

braking prongs carried by said ends of the lower limbs at opposite sides of the ski, said braking prongs being movable between a braking position extending below a lower surface of the ski and a retracted position;

pedal means connected to portions of the upper limbs for moving said braking prongs into the retracted position;

a generally U-shaped coupling member having a central web and having ends connected to said central limbs of said wire frames so as to permit relative movement between said coupling member ends and said central limbs, said bearing member having a holding portion thereof spaced from the pivot axis shaped to releaseably hold the central web of said coupling member whereby conjoint movement of said coupling member and said wire frames moves said wire frames about the pivot axis; and spring means carried by said central limbs of said wire frames for moving said coupling member ends with respect to said pivot axis so that said coupling member moves said braking prongs into the braking position, said central web of said coupling member being selectively releasable from said holding portion to thereby prevent movement of said braking prongs by action of said spring means on said coupling member.

2. A ski brake mountable on a ski for impeding the movement of a ski down a slope when the ski is detached from a skier's boot, said ski brake comprising:

first and second braking spurs, said first braking spur being on the opposing side of the ski from said second braking spur;

a pivot pin having an axis; said braking spurs being moveable about said axis of said pivot pin between a non-braking skiing position and a braking position;

a base plate fixed to said ski, said base plate pivotally connecting said pivot pin to said ski;

an arm attached to said pivot pin, said arm operable by a ski boot for moving said braking spurs from said braking position to said non-braking position when said boot engages said arm;

spring biassing means on said arm for biassing said braking spurs to said braking position when said ski is detached from a skier's boot;

coupling means for coupling said spring biassing means to said ski; and connecting means spaced from said pivot pin axis for releasably connecting said coupling means to said ski, said coupling means being deliberately releasable from said connecting means to disable said spring biassing means.

3. The invention according to claim 2, wherein said arm further comprises two webs substantially perpendicular to said axis of said pivot pin; said webs rotatable about said pivot pin and connected to a pedal; said pedal engageable by the ski boot; said spring biassing means mounted on said webs and engaged by said coupling means; said coupling means displaceable lengthwise along said webs for compressing said spring biassing means when said pedal is engaged by said ski boot.

4. The invention according to claim 3, wherein said coupling means further comprises a yoke for engaging said spring biassing means.

5. A ski brake mountable on a ski for impeding the movement of a ski down a slope when the ski is detached from a skier's boot, said ski brake comprising:

first and second braking spurs, said first braking spur being on the opposing side of the ski from said second braking spur;

a pivot pin having an axis; said braking spurs being moveable about said axis of said pivot pin between a non-braking skiing position and a braking position;

a base plate fixed to said ski, said base plate pivotally connecting said pivot pin to said ski;

an arm attached to said pivot pin, said arm operable by a ski boot for moving said braking spurs from said braking position to said non-braking position when said boot engages said arm;

spring biassing means on said arm for biassing said braking spurs to said braking position when said ski is detached from a skier's boot;

coupling means for coupling said spring biassing means to said ski; and connecting means spaced from said pivot pin axis for releasably connecting said coupling means to said ski, said coupling means being deliberately releasable from said connecting means to disable said spring biassing means;

wherein said connecting means comprises hook means fixed to the ski, said coupling means further comprising a shackle connected to said hook means wherein said shackle is only deliberately releasable from said hook means; release of said shackle disabling said spring biassing means.

6. The invention according to claim 5, wherein said connecting means further comprises abutment means spaced from said hook means and on the side of said hook means remote from said arm; said abutment means cooperating with said hook means to retain said shackle.

* * * * *